US005190083A

United States Patent [19]

Gupta et al.

[11] Patent Number: 5,190,083

[45] Date of Patent: Mar. 2, 1993

[54] MULTIPLE FLUID SPACE DISPENSER AND MONITOR

[75] Inventors: Ashis S. Gupta, Marietta; Leonard F. Antao, Atlanta, both of Ga.

[73] Assignee: The Coca-Cola Company, Atlanta, Ga.

[21] Appl. No.: 770,349

[22] Filed: Oct. 3, 1991

Related U.S. Application Data

[63] Continuation-in-part of Ser. No. 485,506, Feb. 27, 1990, abandoned.

[51] Int. Cl.[5] ..... B65B 3/10

[52] U.S. Cl. ..... 141/18; 141/82; 141/83; 141/351; 141/353; 141/361; 222/37; 222/399; 222/564; 364/550

[58] Field of Search ..... 141/2, 18, 82, 83, 98, 141/346, 347, 348, 349, 351, 353, 360, 361; 99/323.1, 323.2; 222/23, 30, 36, 37, 325, 399, 564, 364; 364/465, 479, 550

[56] References Cited

U.S. PATENT DOCUMENTS

| | | | |
|---|---|---|---|
| 2,695,743 | 11/1954 | Wetherey-Williams | 141/40 |
| 3,103,960 | 9/1963 | Simjian | 141/351 |
| 3,602,273 | 8/1971 | Flentge et al. | 141/313 |
| 3,777,942 | 12/1973 | Fletcher et al. | 222/309 |
| 3,796,239 | 3/1974 | Zindler et al. | 141/83 |
| 4,201,558 | 5/1980 | Schwitters et al. | 62/70 |
| 4,237,536 | 12/1980 | Enelow et al. | 364/465 |
| 4,253,502 | 3/1981 | Guercio | 141/47 |
| 4,493,441 | 1/1985 | Sedam et al. | 222/129.1 |
| 4,506,709 | 3/1985 | Denhardt | 141/95 |
| 4,519,428 | 3/1985 | Moody | 141/98 |
| 4,629,589 | 12/1986 | Gupta et al. | 222/129.1 X |
| 4,687,120 | 8/1987 | McMillin | 222/1 |
| 4,709,734 | 12/1987 | Rudick et al. | 141/2 |
| 4,721,035 | 1/1988 | Chang-Diaz | 99/297 |
| 4,738,113 | 4/1988 | Rudick | 62/3 |
| 4,752,018 | 6/1988 | Rudick et al. | 222/1 |
| 4,785,974 | 11/1988 | Rudick et al. | 222/105 |
| 4,827,426 | 5/1989 | Patton et al. | 364/479 |
| 4,836,414 | 6/1989 | Credle, Jr. et al. | 222/1 |
| 4,846,234 | 7/1989 | Rudick | 141/98 |
| 4,848,418 | 7/1989 | Rudick et al. | 141/5 |
| 4,875,508 | 10/1989 | Burke, II et al. | 141/2 |
| 4,892,125 | 1/1990 | Rudick et al. | 141/353 |
| 4,901,887 | 2/1990 | Burton | 222/131 |
| 4,907,724 | 3/1990 | Wing et al. | 222/105 |
| 4,911,212 | 3/1990 | Burton | 141/369 |
| 4,930,555 | 6/1990 | Rudick | 141/98 |
| 4,932,561 | 6/1990 | Boxall | 222/54 |
| 4,934,419 | 6/1990 | Lamont et al. | 364/465 X |
| 5,091,713 | 2/1992 | Horne et al. | 364/479 X |

FOREIGN PATENT DOCUMENTS

| | | | |
|---|---|---|---|
| 320262 | 6/1989 | European Pat. Off. | 222/129.1 |
| 238225 | 8/1986 | Fed. Rep. of Germany | 141/83 |

*Primary Examiner*—Henry J. Recla
*Assistant Examiner*—Casey Jacyna
*Attorney, Agent, or Firm*—Birch, Stewart, Kolasch & Birch

[57] ABSTRACT

A dispensing system is provided for dispensing and monitoring output and consumption of fluids in the microgravity conditions of outer space. The dispensing system conveniently dispenses a plurality of fluid from distinct output ports into a corresponding suitable receptacle. Each consumer is identified at a point of delivery of the fluid and fluid dispensing and/or consumption is monitored and displayed according to predetermined criteria.

4 Claims, 4 Drawing Sheets

MULTIPLE FLUID SPACE DISPENSER AND MONITOR

This application is a continuation-in-part of application Ser. No. 07/485,506 filed on Feb. 27, 1990, now abandoned.

BACKGROUND OF THE INVENTION

Field of the Invention

The present application is directed to a method and apparatus for dispensing and monitoring consumption of fluids in the microgravity conditions of outer space.

It is know that zero or microgravity conditions of outer space prevent consumption of beverages from a conventional pre-mix container directly into a consumer's mouth, and further that refilling of conventional drinking containers presents a serious problem, especially with regard to carbonated beverages.

Similarly, with only a limited supply of fluids aboard a spacecraft or space station, control of consumption and fluid use should be monitored for scientific data gathering as well as a means to properly share and allocate fluid consumption.

The microgravity dispenser described in U.S. Pat. No. 4,848,418 to Rudick et al was particularly designed for dispensing pre-mix beverages in the microgravity conditions of outer space. Further, U.S. Pat. No. 4,875,508 to Burke, II et al and U.S. Pat. No. 4,785,974 to Rudick et al describe types of drinking containers which may be used in the microgravity conditions of outer space.

A problem still exists, however, in adapting these known dispensers and containers to a closed controlled system capable of monitoring consumption of a plurality of fluids according to type of fluid and known consumer thereof which is effectively used with both carbonated and still fluids.

SUMMARY OF THE INVENTION

Accordingly, it is a primary object of the present invention to provide a system and apparatus for dispensing a plurality of different fluids in the microgravity conditions of outer space.

It is another object of the present invention to provide a closed system and apparatus for dispensing and monitoring the dispensing of both carbonated and still beverages in the microgravity conditions of outer space, the monitoring including recordation of type, amount, and consumer of each of a plurality of fluids.

The objects of the present invention are fulfilled by providing a system for selectively dispensing a plurality of fluids in the microgravity conditions of outer space comprising:

a plurality of fluid supply containers, at least one of said plurality of fluid supply containers being filled with a carbonated pre-mix beverage;

means for cooling said plurality of fluid supply containers;

means for maintaining said container of carbonated pre-mix beverage in solution;

a plurality of fluid dispensing ports, connected to respective ones of said plurality of fluid supply containers, for dispensing fluids from said microgravity dispenser;

a normally closed portable drinking container operatively connectable to at least one of said plurality of fluid dispensing ports for receiving the dispensed fluids;

means, associated with said container of carbonated pre-mix beverage, for controlling a dispensing flow rate thereof thereby preventing carbon dioxide breakout from said carbonated pre-mix beverage;

means for monitoring dispensed fluids according to predetermined criteria, said means for monitoring including a computerized tabulation device for determining and storing a plurality of variables including type and quantity of dispensed fluids and recipients of said dispensed fluids; and means for initiating a dispensing operation, said means for initiating being a pressure switch positioned in each of said plurality of fluid dispensing ports, and said pressure switch actuation further initiating a tabulation routine of said means for monitoring whereby consumption history is determined for each user.

Further scope of applicability of the present invention will become apparent from the detailed description given hereinafter. However, it should be understood that the detailed description and specific examples, while indicating preferred embodiments of the present invention, are given by way of illustration only, since various changes and modification within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
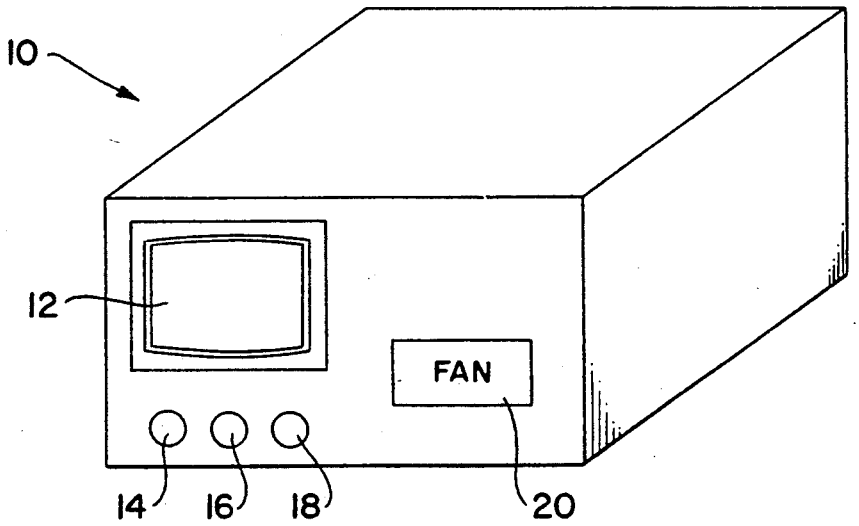
FIG. 1 is a perspective view of a microgravity dispenser system according to a preferred embodiment of the invention.

Referring to FIG. 1, there is generally shown at 10 a perspective view of a microgravity dispenser system for delivering any one of a plurality of fluids in the microgravity conditions of outer space.

It should be understood that an absence of gravity in space will render conventional earth based dispensers inoperable. Accordingly, the present dispenser has been designed specifically for operation in space. Further, the confined nature of space shuttles and future space stations requires that fluids be monitored in order to track consumption and maintain an accurate inventory. The dispenser according to the present invention, therefore, is operable for a plurality of different fluids and has the ability to monitor each fluid dispensed.

Referring again to FIG. 1, any number of fluids may be dispensed as dimensions of the system permits, but for purposes of explanation, three dispensing ports 14, 16 and 18 are shown which dispense one carbonated pre-mix beverage, water, and a biological fluid such as blood plasma, respectively. The same technology described herein may be used for any number of fluids, including carbonated and still fluids.

Also shown in FIG. 1 is a display monitor 12 such as a cathode ray tube (CRT) screen. The monitor 12 may be used to present fluid selection possibilities to the user, and for displaying information to the user including his identity, present selection of fluid, total fluid consumption over a most recent 24 hour period and the like.

A fan or blower 20 is provided to circulate air in a refrigerator section of the dispenser 10 as will be more fully explained.

Figure 2:
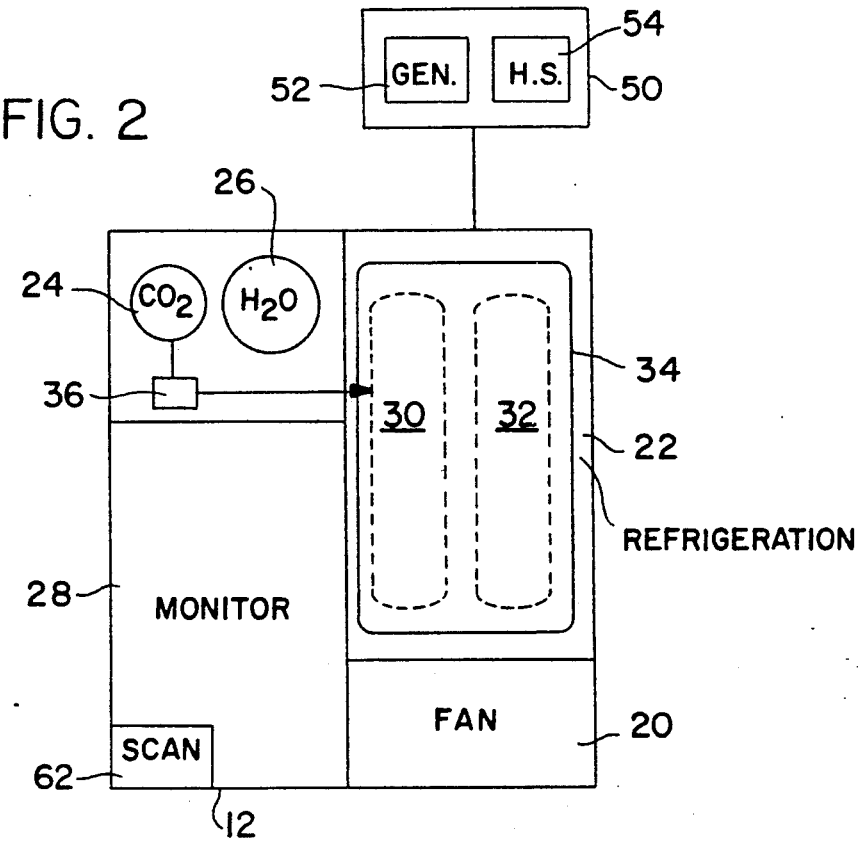
FIG. 2 is a top view of the microgravity dispenser shown in FIG. 1.

FIG. 2 is a top view of the microgravity dispenser shown in FIG. 1. Blower 20 is positioned at the front of the dispenser 10 and forward of a refrigeration compartment 22 positioned along the right hand side of the dispenser. Any convenient location may be employed for the refrigeration compartment 22, however, so long as the fan 20 has access to an unconfined end of the dispenser to blow air against the refrigeration compartment 22. Preferably, thermoelectric cooling is utilized to cool the fluids stored within the refrigeration compartment 22. Such thermoelectric cooling is shown, for example, in U.S. Pat. No. 4,738,113 to Rudick. In connection with the present invention, there is shown a cold plate 34 upon which one or more cooled containers 30, 32 securely rest by means of a hook-and-pile type fastener or the like. These containers may include a pre-mix beverage 30 and/or a blood plasma 32 as previously explained. A thermoelectric generator 50 is disposed in a separate cabinet connected to one end of the refrigeration compartment 22 and includes thermoelectric elements 52 and a heat sink 54 operatively associated with both the cold plate 34 and the refrigeration compartment 22. The fan 20 draws air into and through the heat sink in order to ensure efficient operation of the thermoelectric cooling elements.

Also shown in FIG. 2 is a water reservoir 26 for supplying fresh water through outlet port hole 16.

Carbonated beverages are more difficult to handle in space than are the still fluids such as water and blood plasma. This is due primarily to the fact that gas tends to separate from the liquid in carbonated beverages. Since no gas/liquid separation can occur in the microgravity conditions of outer space, the carbonated beverage will become a frothy mixture if released into an uncontrolled environment. The frothing is caused by two factors. The first factor is a process of desorbing carbon dioxide from the product and the second factor relates to gas being present in the head space of a container having a carbonated beverage therein. In order to prevent desorbtion of carbon dioxide ($CO_2$), the gas must be maintained in solution at all times. It is known that solubility of carbon dioxide gas at a given temperature is determined by a saturation pressure thereof. Maintenance of a liquid phase requires that the product be constantly stored at or above the determined saturation pressure.

The following table identifies the saturation pressure at varying carbonation levels and a constant temperature of 75° F.

| Carbonation | Temperature | Pressure |
|---|---|---|
| 1.5 | 75° F. | 14 Psig |
| 2.0 | 75° F. | 24 Psig |
| 2.5 | 75° F. | 32 Psig |
| 3.5 | 75° F. | 50 Psig |

Since the cabin temperature or temperature of a space station could be as high as 75° F. due to its controlled temperature environment, the saturation pressures were calculated at that temperature. Of course, any known temperature may be used in the same manner.

The problem of head space as well as the need to maintain a liquid phase in a storage container of carbonated pre-mix beverage 30 is accomplished by using a collapsible bag within the container. A modified five gallon (hereinafter FIGAL) container suitable for storing the carbonated beverage is described, for example, in U.S. Pat. No. 4,848,418 to Rudick et al. In particular, a container such as beverage pre-mix container 30 is modified to contain the pre-mix in a bag formed within the container. A carbon dioxide source 24 is connected to the container 30 through a regulator 36. The regulator 36 is set so as to maintain the carbonated pre-mix within the container 30 at a predetermined setting according to the table shown above. Preferably, if the temperature is 75° F. and the preferred carbonation is 2.5 volumes, then the pressure regulator should be set to 32 psig.

Thus, an annular space between the bag and container wall is pressurized with $CO_2$ gas at a constant pressure from the carbon dioxide cylinder 24. As the product is dispensed, the carbon dioxide gas squeezes the bag, keeping the product under pressure and eliminating any head space which might otherwise form therein.

Another problem which must be addressed is the pressure drop which will occur when the carbonated pre-mix beverage exits the container. Specifically, if pressure is allowed to drop suddenly from the saturation pressure maintained inside the container to a pressure of one psig at the dispensing port 14, the product will no longer be at or above its saturation pressure. Consequently, carbon dioxide gas will escape from the product resulting in severe foaming. Instead of a refreshing carbonated beverage, the consumer will be confronted with a product resembling shaving cream.

Figure 6:
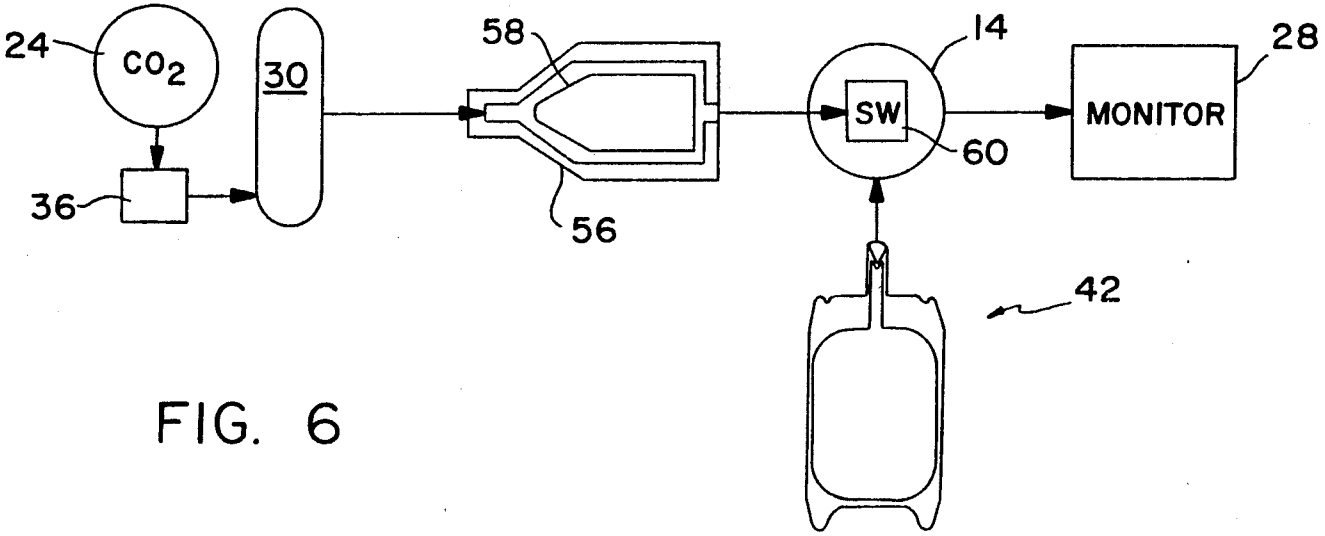
FIG. 6 is a diagrammatic representation of an inline flow rate control valve and primary related functional elements.

It is known, however, that carbon dioxide gas exhibits a pseudo equilibrium property such that if the pressure of the product is lowered gradually, the $CO_2$ gas will remain in the product as a supersaturated solution. The present invention solves this problem by providing a dispensing valve 56 in the container or in-line in a dispensing tube adjacent the container, or further adjacent a port hole outlet 14 associated with the carbonated pre-mix beverage as shown in FIG. 6.

A dispensing valve member 58 is conical-shaped with a steadily widening annular cross-section in the direction of fluid flow from the container 30 to the dispensing outlet port 14. By increasing the cross-sectional area of product flow, the liquid pressure gradually decreases, thereby maintaining a laminar flow at all times. Further, flow rate may be adjusted by a screw at the top of the container 30 whereby tightening of the screw decreases the cross-sectional area of product flow and thus lowers the rate of flow. Examples of this type of valve may be seen in U.S. Pat. No. 4,848,418 to Rudick et al, and U.S. Pat. No. 4,709,734 to Rudick et al, U.S. Pat. No. 4,752,018 to Rudick et al which describe a flow control valve having a bullet-shaped piston member therein responsible for delivering the carbonated pre-mix from the FIGAL to a receiving cup at a controlled rate of flow at low pressure and are incorporated herein by reference. An inlet side of the valve is a narrow end of the "cone" and a bullet member is of a complementary shape to the valve and is disposed within the valve housing. The piston has a first cone portion and a second cylindrical portion whose shape prevents any appreciable variation of flow rate and lowers the pressure of the pre-mix to an ambient pressure without any appreciable carbonation breakout or foaming.

For non-carbonated fluids, the conical dispensing valve is not necessary. Flow rates for the water and blood plasma may be adjusted by in-line flow regulating devices such as fixed orifices and the like. Since the product is at a constant pressure, the flow rate through the orifice will also be constant.

Figure 4:
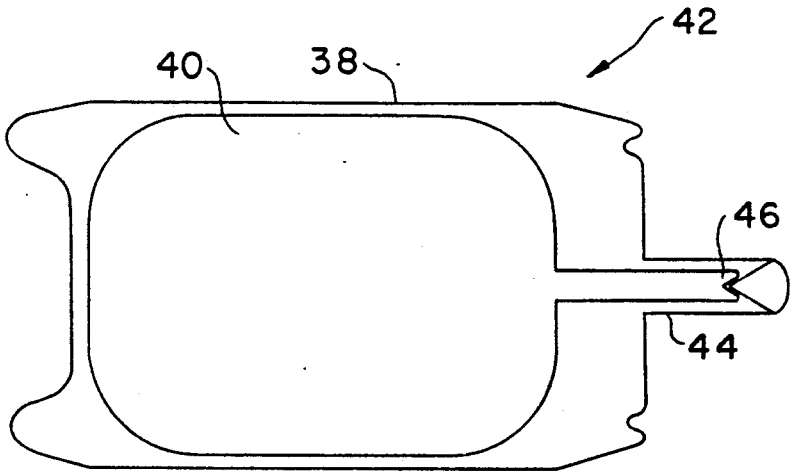
FIG. 4 is a cross-sectional view in side elevation of a conventional microgravity drinking cup for use with the microgravity dispenser of the present invention.
Figure 5:
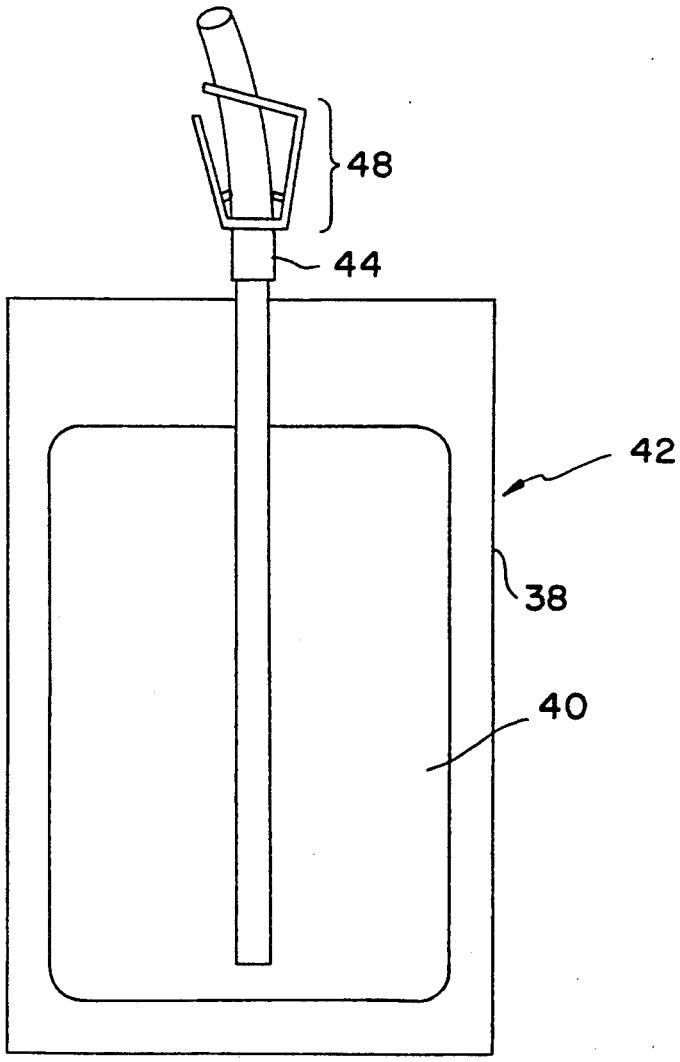
FIG. 5 is a cross-sectional view of another conventional microgravity drinking cup for use with the present invention.

Dispensing of any of the plurality of liquid must be into a smaller container which is usable for direct consumption or end use in the case of blood plasma fluid. It is of primary importance that fluids being dispensed do not escape into the cabin of the space shuttle or into the open areas of the space station. For this reason, a portable drinking container is utilized such as that shown in attached FIGS. 4 and 5. Each of these drinking containers are formed of a rigid exostructure 38 with a collapsible bag 40 inside. The exostructure includes stem engageable with any one of the plurality of dispensing outlets 14, 16, or 18. By this arrangement, the fluid product may be dispensed directly into the bag 40 of the cup 42. The stem 44 of the drinking cup 42 has a check valve 46 formed therein to prevent liquid from escaping from the drinking container when it is removed from the dispenser. Preferably, a duckbill type check valve 46 is utilized as shown in FIG. 4, but a clamp 48 or similar structure as shown in FIG. 5 may be used. Drinking of the carbonated beverage or water may be accomplished by releasing the valve, and dispensing of the blood plasma is achieved the same way into a suitable receptacle.

Also shown in FIG. 2 is a computerized monitoring area 28 for use in determining the identity of the consumer, tabulating a fluid withdrawal, and calculating recent consumption over a predetermined period of time, usually 24 hours. When an astronaut inserts a drinking cup 42 into any one of the plurality of outlets 14, 16 or 18, a pressure switch 60 alerts the computer 28 and a scanner 62 provided in connection therewith identifies the drinking cup 42 to determine its user. Determination can also be made by binary switches and the like. When the user has been identified, the user's consumption history is recalled and updated. As mentioned, the previous consumption history for a predetermined period of time will also be displayed.

FIG. 6 is a diagrammatic representation of an inline flow rate control valve 56 as previously described. It can be seen that the $CO_2$ source propels a carbonated beverage from container 30 via the pressure regulating valve 36. A laminar flow of beverage across conical valve 56 enables foam-free dispensing at outlet port 14 upon insertion of the mouth 44 therein, thereby activating pressure switch 60. Monitoring of dispensing occurs at monitor 28.

Figure 3:
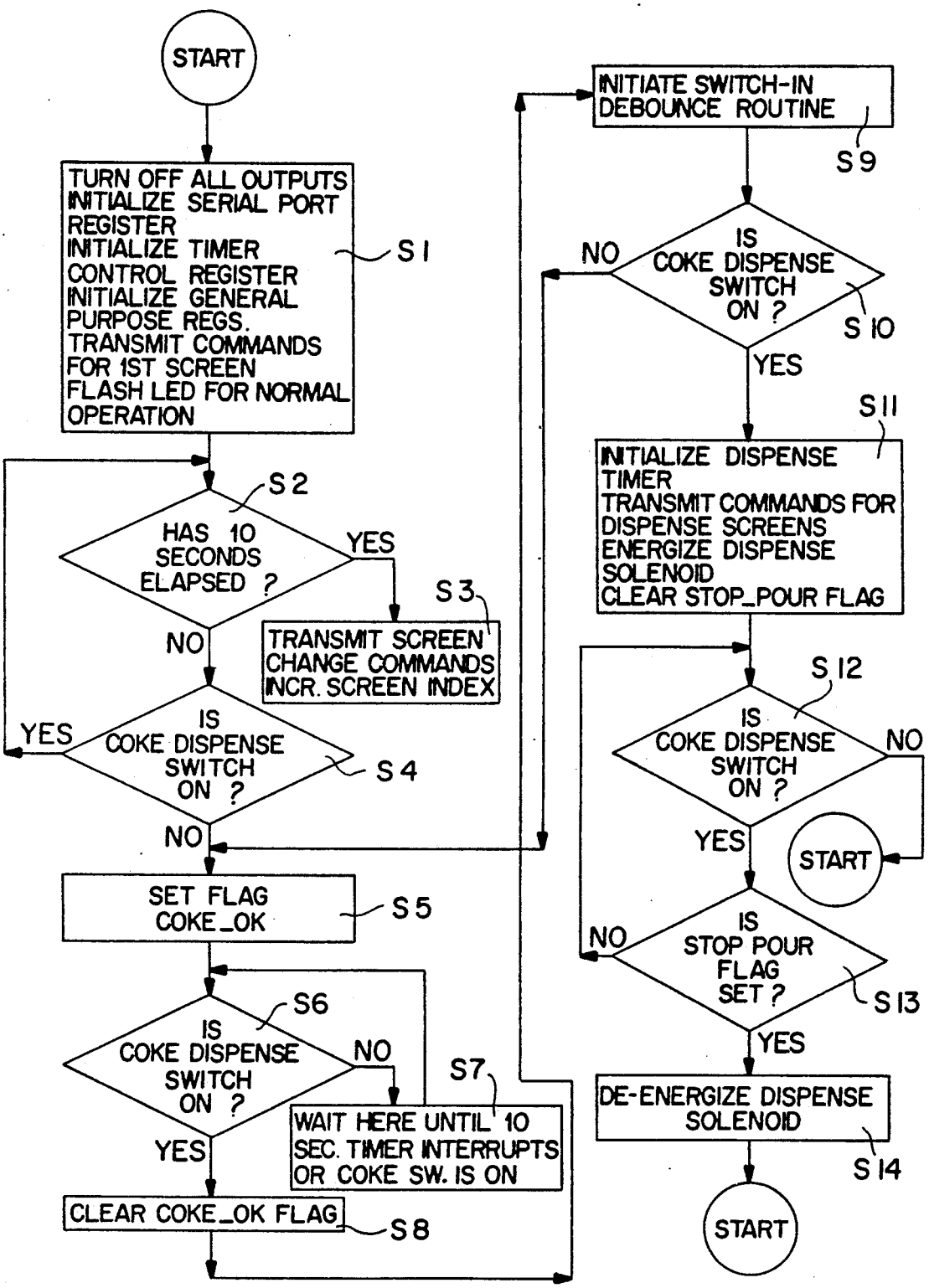
FIG. 3 is a flow diagram explaining a dispensing procedure for the microgravity dispenser of the present invention.

Referring now to FIG. 3, there will be described a simplified operation of the microgravity dispenser. When all systems have been turned "ON" within the space shuttle or space station, the microgravity dispenser will also be in an "ON" and usable condition until power supply is terminated. Auxiliary power may be provided if desired so that the thermoelectric cooling device will continually maintain the refrigeration area 22 at an optimum temperature for the pre-mix beverage and blood plasma.

Next, at step S1, all outputs 14, 16, and 18 are closed, and various registers and data control areas in the computer 28 are initialized. Instructions are displayed at the viewing monitor 12, and an LED is flashed to indicate to the operator that normal operations of the dispenser may proceed. At step S2 it is determined if a predetermined period of time (10 seconds) have elapsed. If so, the viewing monitor is updated to provide the operator with additional information. If the predetermined period of time has not elapsed, it is determined at step S4 if the pressure switch has been actuated. If yes,then steps S2 and S3 are repeated or the loop is continued between steps S2 and S4 until 10 seconds have elapsed.

If the pressure switch has not been actuated in step S4, then an appropriate flag is set in step S5 and it is again determined in step S6 if the pressure switch has been actuated. If detection of the pressure switch is not detected in step S6, then the system proceeds to step S7 for either waiting 10 seconds or the pressure switch is actuated. If the pressure switch is detected in step S6, then a clear signal is sent at step S8, thereby initiating a switch-on debounce routine in step S9 which involves a time delay causing the computer to read a switch press as a single press rather than several presses since depressing a mechanical switch causes a circuit to open and close several times which is read by the computer as several switch presses, and another determination in step S1, if the pressure switch is still being activated. If no, the program returns to step S5 above. If yes, then a dispensing timer is initialized, commands are transmitted to the viewing monitor, and a dispensing solenoid is activated for a predetermined period of time. At step S12 it is again detected if the pressure switch is activated. If no such activation is detected, the program returns to step S1. If the pressure switch activation is detected, a determination is made at step S13 if a stop-pour flag is set. If the stop-pour flag is set, the dispense solenoid is de-energized at step S14 to terminate a dispensing operation. Otherwise, the program returns to step S12.

For hydroponic studies, the computer will water and/or fertilize one or more plants at a predetermined time, record the time and amount of water and fertilizer dispensed, then display the data upon request for the same.

Similarly, the dispenser will dispense, on demand, an aliquot of blood plasma for biological studies and keep a record of time and quality of blood plasma dispensed.

Finally, the space requirements of the microgravity dispenser are fairly minimal at about 17.3 inches in width, 20 inches in depth and almost 10 inches in overall height. As long as the fan or blower 20 is at the front of the dispenser, it may be placed anywhere within easy reach of the astronauts. Further, power requirements are minimal since the dispenser will use less than 100 watts.

It should be understood that the microgravity dispenser and monitoring system described herein may be modified as would occur to one of ordinary skill in the art without departing from the spirit and scope of the present invention.

I claim:

1. A dispensing system for use in the microgravity conditions of outer space comprising:

a plurality of fluid supply containers, at least one of said plurality of fluid supply containers being filled with a carbonated pre-mix beverage, at least one being filled with water, and at least one being filled with blood plasma;

means for cooling said plurality of fluid supply containers;

means for maintaining the carbon dioxide in said carbonated pre-mix beverage in solution;

a plurality of fluid dispensing ports, connected to respective ones of said plurality of fluid supply containers, for dispensing fluids from said microgravity dispensing system;

a plurality of portable containers selectively connectable to said plurality of fluid dispensing ports for receiving the dispensed fluids, each said container including indicia thereon for identifying the user of the container;

means, associated with said container of carbonated pre-mix beverage, for controlling a dispensing flow rate therefrom thereby preventing carbon dioxide breakout from said carbonated pre-mix beverage, said means for controlling a dispensing flow rate includes an inverted conical valve member in-line with said carbonated beverage container, whereby an increasing annular cross-section of the valve enables a cross-sectional area of product flow to increase, thereby decreasing an atmospheric pressure of the fluid and maintaining a laminar flow;

scanning means associated with each dispensing port for reading said indicia on a container connected thereto and generating an identification signal;

means for monitoring dispensed fluids according to predetermined criteria, said means for monitoring including a computerized tabulation device for determining and storing a plurality of variable including type and quantity of dispensed fluids and processing the identification signal to determine the identity of users of said dispensed fluids, and a viewing screen in close proximity to the dispensing ports for displaying said variables and identity of users; and means for initiating a dispensing operation, said means for initiating including a switch positioned in each of said plurality of fluid dispensing ports, said switch being actuated in response to insertion of said drinking container or other types of containers into any one of said fluid dispensing ports to initiate the dispensing operation, and the actuation of said switch further initiating a tabulation routine of said means for monitoring whereby consumption history is determined for the user identified by the identification signal and displayed on said viewing screen.

2. The dispenser according to claim 1, wherein said means for cooling includes a circulation fan and a heat exchange means in communication with said plurality of fluid supply containers.

3. The dispenser according to claim 1, wherein said means for cooling includes a cold plate surrounding at least one of said plurality of fluid supply containers.

4. The dispenser according to claim 1, wherein said means for maintaining said carbonated pre-mix beverage in solution includes a $CO_2$ supply for applying $CO_2$ gas to an interior portion of said carbonated pre-mix beverage container.

* * * * *